US005666697A

United States Patent [19]

Giuliani

[11] Patent Number: 5,666,697

[45] Date of Patent: Sep. 16, 1997

[54] CARD OF THE TANDEM-CARD TYPE WITH FIXED CARDING UNITS BELOW A CARDING CYLINDER

[76] Inventor: Marcello Giuliani, Via Cellerese 33, 50013 Campi Bisenzio, Firenze, Italy

[21] Appl. No.: 640,916

[22] PCT Filed: Nov. 9, 1994

[86] PCT No.: PCT/IT94/00189

§ 371 Date: May 10, 1996

§ 102(e) Date: May 10, 1996

[87] PCT Pub. No.: WO95/13411

PCT Pub. Date: May 18, 1995

[30] Foreign Application Priority Data

Nov. 11, 1993 [IT] Italy ..... FI93A0227

[51] Int. Cl.[6] ..... D01G 15/02; D01G 15/24

[52] U.S. Cl. ..... 19/98; 19/99

[58] Field of Search ..... 19/98, 99, 150

[56] References Cited

U.S. PATENT DOCUMENTS

| | | | |
|---|---|---|---|
| 3,097,399 | 7/1963 | Alston | 19/98 |
| 3,999,249 | 12/1976 | Katoh et al. | 19/98 X |
| 4,115,903 | 9/1978 | Barber | 19/99 |
| 4,128,917 | 12/1978 | Varga | 19/98 X |
| 4,219,908 | 9/1980 | Winch et al. | 19/99 |
| 4,797,978 | 1/1989 | Giuliani | 19/98 |
| 5,016,321 | 5/1991 | Hollingsworth et al. | 19/98 |
| 5,111,551 | 5/1992 | Hollingsworth et al. | 19/150 |

FOREIGN PATENT DOCUMENTS

| | | | |
|---|---|---|---|
| 183102 | 8/1966 | U.S.S.R. | 19/98 |
| 335297 | 6/1972 | U.S.S.R. | 19/98 |
| 825703 | 4/1981 | U.S.S.R. | 19/98 |

*Primary Examiner*—John J. Calvert

[57] ABSTRACT

The card comprises a first-taker-in (3) and a conveying-carding roller (7), a first carding cylinder or main cylinder (9), a first doffer roller (12), a second carding cylinder (14), a second doffer roller (18) and a web removing assembly (20); at least the first carding cylinder or main cylinder (9) has its fixed carding units (10), which cooperate with its clothing, arranged around the lower periphery of the cylinder.

5 Claims, 2 Drawing Sheets

70
64
66
68
62
59
60
65
57
51

CARD OF THE TANDEM-CARD TYPE WITH FIXED CARDING UNITS BELOW A CARDING CYLINDER

TECHNICAL FIELD

The subject of the invention is an improved embodiment of a card of the tandem-card type, that is a card comprising a feed assembly, initial rollers (such as a taker-in and a conveying-carding roller), a first carding cylinder, a first doffer roller, a second carding cylinder, a second doffer roller and a web removing assembly.

SUMMARY OF THE INVENTION

It is an object of the invention to provide a structure offering advantages that will become obvious as the following text is read.

A card of the tandem-card type—comprising a feed assembly, initial rollers (such as a taker-in and/or a conveying-carding roller) a first carding cylinder or main cylinder, a first doffer roller, a second carding cylinder, a second doffer roller and a web removing assembly—according to the invention is characterized in that the fixed carding units, which cooperate with the clothing of the first carding cylinder or main cylinder, are arranged around the lower periphery of the latter, and in that the first doffer roller cooperates not only with the first carding cylinder, but also directly with the second carding cylinder, thereby eliminating a transferer-stripper from between them.

In practice said carding units are arranged around a fraction of approximately 270° around the lower periphery of said first carding cylinder, while the remaining upper arc is available for the conveying and carding roller and for the first doffer roller.

The carding units are separated by a suitable distance from each other in order to enable impurities to be eliminated, their removal being facilitated by gravity.

Advantageously, underneath said first carding cylinder and its associated fixed carding units is a collecting hopper with suction means operating from beneath.

BRIEF DESCRIPTION OF THE DRAWINGS

The invention will be understood more clearly on examining the description and accompanying drawing, the latter showing a practical non-restricting embodiment by way of example. In the drawing.

DETAILED DESCRIPTION OF THE PREFERRED EMBODIMENT

Figure 1:
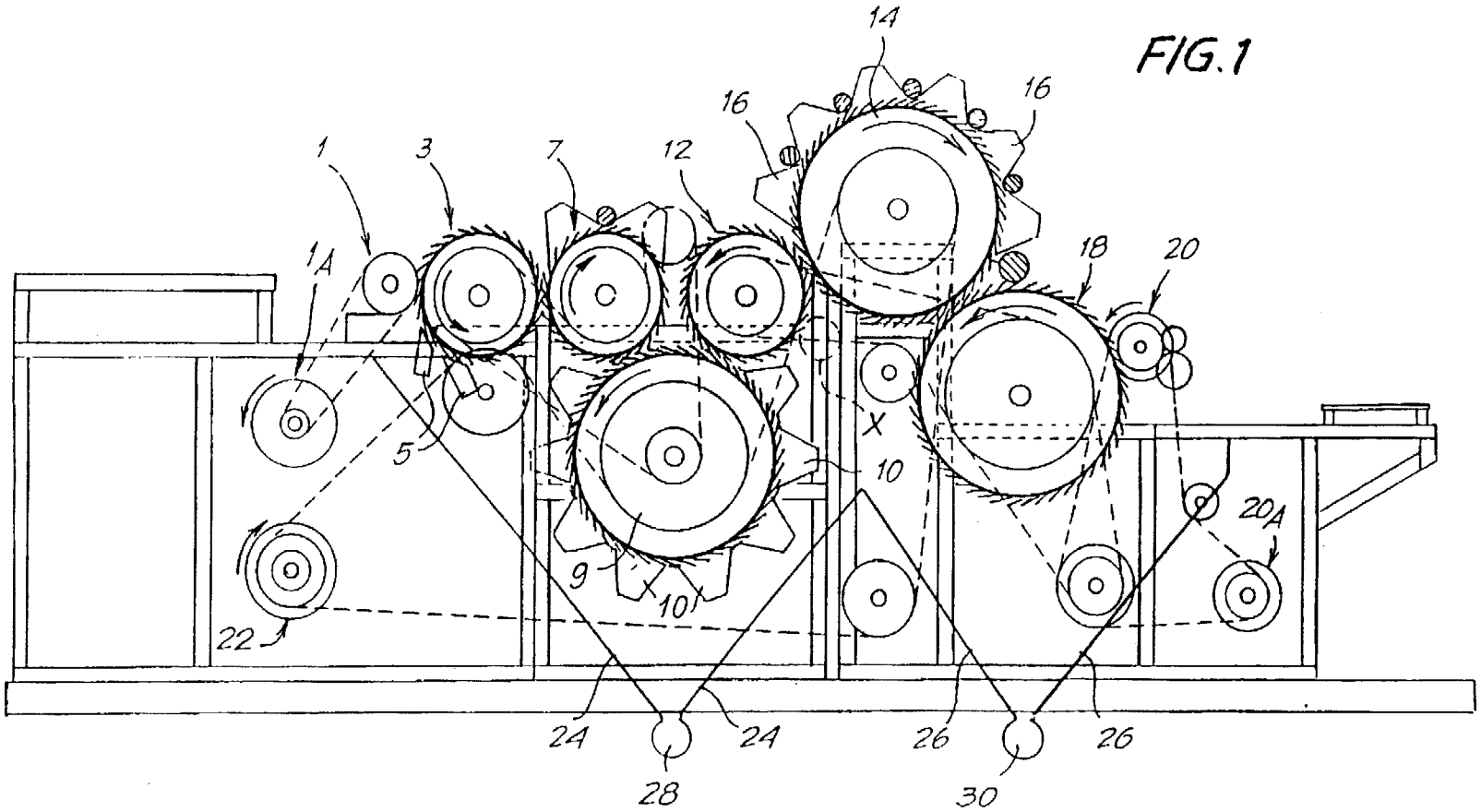
FIG. 1 schematically shows a tandem-card assembly which realizes the arrangement according to the invention.

In FIG. 1 of the accompanying drawing, the numeral 1 indicates the introducing system which may simply take the form of an introducing roller powered by a drive 1A. The material is fed to a working roller known as a taker-in, indicated 3 as a whole, which rotates in the direction shown by its arrow and is covered with clothing whose points are inclined as shown in the drawing in order to strip the material. The taker-in roller 3 is essentially a cleaning and carding roller. The roller 3 may have blades such as 5 underneath it to cooperate with the clothing of the roller 3. The numeral 7 indicates a conveying and carding roller that rotates in the direction shown by its arrow, the points of its clothing being inclined in the direction indicated in the drawing in order to strip the material from the taker-in roller 3 and transfer it directly to a first carding cylinder or main cylinder 9; this cylinder rotates in the direction indicated by its arrow and the points of its clothing are inclined as indicated in the drawing, in order to remove the material from the conveying roller 7 and perform the carding with fixed carding units, which are indicated as a whole by the numeral 10; the units 10 are separated by a suitable distance from each other in order to enable impurities to be removed, this being assisted by gravity. Also cooperating with the carding cylinder 9 is a doffer roller 12 which removes the material from the cylinder 9; said doffer roller 12 rotates in the direction shown by its arrow and the points of its clothing are inclined as indicated in the drawing.

It will be seen from the drawing that, characteristically, both the conveying and carding roller 7 and the first doffer roller 12 are above the main cylinder or carding cylinder 9, whereas all the fixed carding units 10 are arranged in the lower region of the periphery of the main cylinder or carding cylinder 9; in effect, the fixed carding units 10 cooperate with approximately ¾ at least of the periphery of the main cylinder or carding cylinder 9 in the lower region of the clothing of the main cylinder, covering an angular arc of approximately 270°, while the remaining upper arc provides the necessary space for the two rollers 7 and 12 cooperating with the carding cylinder or main cylinder 9.

From the doffer roller 12 the material transferred directly—without the stripper—to second carding cylinder 14 provided with fixed carding units 16. The cylinder 14 rotates in the direction shown by its arrow and the points of its clothing inclined in the manner indicated in the drawing, in order to strip the carded material from the doffer roller 12 and complete the carding action.

It should be noted, as a second characteristic circumstance, that the present card does not have the transferer and stripper normally provided in conventional cards for transferring the material, i.e. stripping it from the clothings of the different rollers in order to carry the already sufficiently carded material to said second carding cylinder 14; this dispensing with the transferer and stripper—which in conventional machines is located approximately in the position indicated by the X in the drawing—is made possible by virtue of the arrangement of the fixed carding units 10 underneath the main cylinder or carding cylinder 9 and by the corresponding arrangement of the conveying roller 7 and doffer roller 12.

Figure 2:
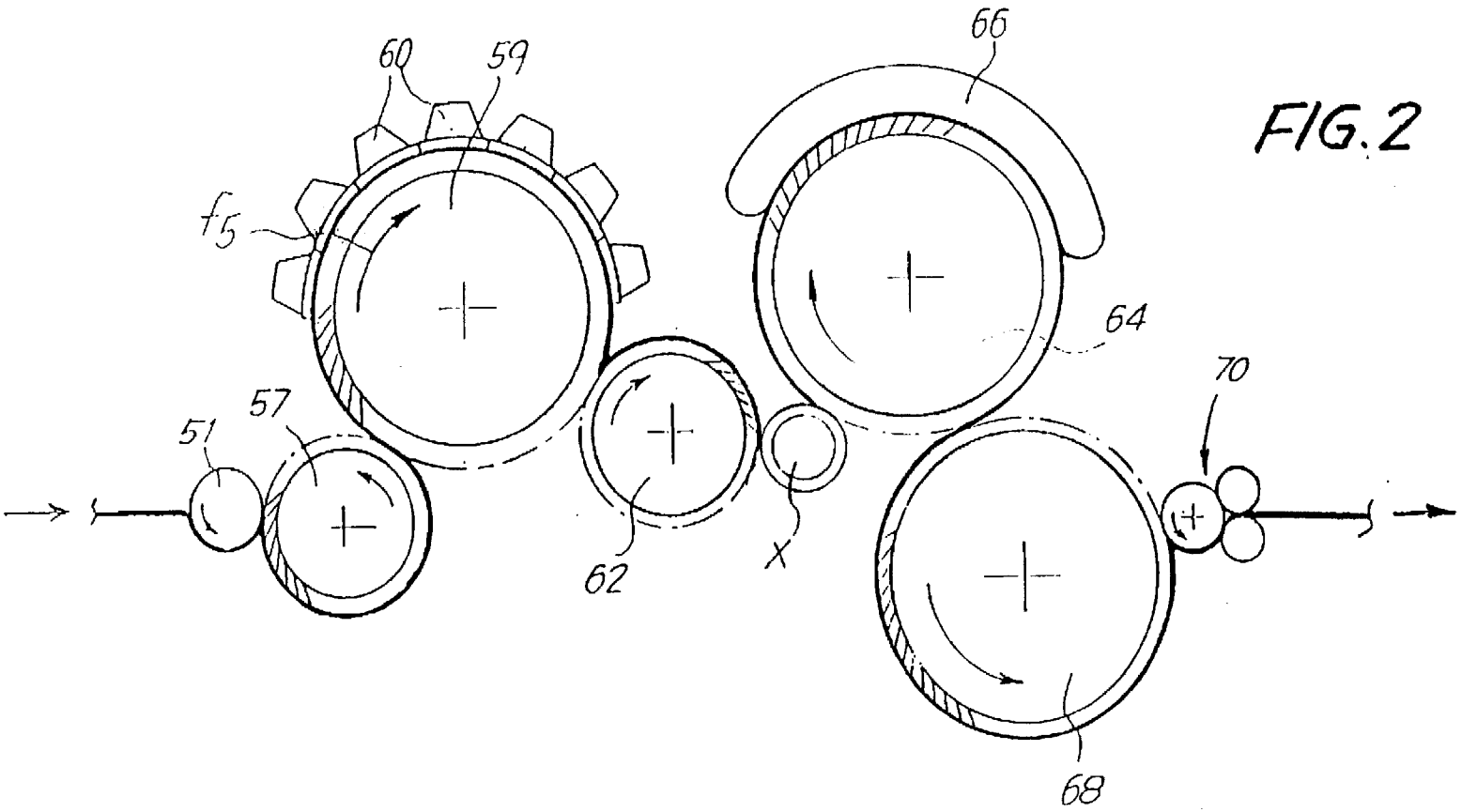
FIG. 2 shows for comparison an earlier carding frame.

In order to facilitate the understanding of those features which distinguish the invention from conventional solutions, FIG. 2 illustrates an earlier tandem-card frame; parts corresponding to the parts in FIG. 1 are indicated by the same reference numerals plus "50". The following will be observed:

- the inverted position of the conveyor 7 and of the main cylinder 9 as compared with parts 57 and 59;
- the inversion of the direction of rotation of the main cylinder 9 as compared with the direction of rotation of 59;
- the inverted position of the carding units 10 around the main cylinder 9 as compared with the units 60 around cylinder 59;
- the direct transference of the fibres from the doffer 12 to the main cylinder 14, as opposed to the double transference of the material from the doffer 62 to the conveyor X and from this to the main cylinder 64, resulting in stressing of the fibres.

The prior frame of FIG. 2 uses only one roller 57; the frame according to the invention (FIG. 1) uses the two cylinders 3 and 7, by which means a greater cleaning action of the fibres is obtained and a greater initial combing effect.

From the second carding cylinder 14 the material is transferred to a second doffer roller 18 rotating in the direction of the arrow and more slowly at its surface than the carding cylinder 14, in order to strip off the material, which is then transferred to the web removing assembly, of which the web removing roller 20 is indicated in particular.

In addition to the drive 1A at the feeding-in end, a drive 20A is provided at the outlet end and also a main drive 22.

The fixed carding units may be of conventional type or may be of the types already described in other earlier patents by the present proprietor.

The machine is completed by hopper conveying systems 24 and 26 which bring together material rejected, with the help of gravity, by the processing carried out as the textile material travels through the machine, again by gravity down to the bottom of the hoppers 24 and 26 and into suction units 28 which are purely illustrative embodiments of means for removing the residues, since it is possible for these means to take some other form. Material rejected by the carding means and hence removed from the material that does undergo carding is easily collected by gravity alone in the hoppers 24, 26 and carried away, with no risk of its being reintroduced into the material.

There are clear advantages to the construction described, especially as regards the following aspects.

Among the advantages that can be obtained with the tandem card according to the invention, that is with the carding cylinder working in the low position, the following may be highlighted in particular:

A—an increase in the amount of space available for carding, of up to 80% of the surface of the cylinder 9;

B—in the presence of the spaces between the flats or carding units 10 and owing to the position of these, the impurities fall directly into the hopper 26, resulting in a thorough cleaning Of all impurities present in the fibres;

C—since the arrangement of the machine is inverted, that is the units 10 are underneath, and since the various components 7, 9, 12 rotate in the direction indicated by their respective arrows, it is possible to dispense with the stripper (X) between the doffer 12 and second cylinder 14; this is because the points of the clothing of the doffer 12 are inclined in the correct direction to be directly stripped by the second main cylinder 14; the transference of the fiber from the doffer of the first card to the cylinder of the second card without the use of a conveying cylinder is due to the inversion of the motion of the cylinder of the first card, and consequently the inclination of the points of the clothing is also inverted. This reversal of inclination enables us to strip the doffer of the first card directly with the cylinder of the second card;

D—by removing said stripper (X), the revolving of the fibres is done away with, these fibres being already straight and parallel owing to the carding effected by the carding rollers upstream of the second carding cylinder 14; this improves the quantity and quality of the output of the second card 14, which will present a web whose fibres are perfectly parallel, with fewer broken fibres, and also with an increase in production.

It will be understood that the drawing is only an illustrative embodiment provided purely by way of a practical demonstration of the invention, for it is possible for the invention to vary as regards shapes and arrangements without thereby departing from the scope of the concept underlying said invention. The purpose of any reference numerals in the accompanying claims is to facilitate the reading of the claims with reference to the description and drawing, and does not limit the scope of protection represented by the claims.

I claim:

1. A card of the tandem-card type, comprising a feed assembly (1), a first taker-in (3), a conveying-carding roller (7), a first carding cylinder or main cylinder (9), a first doffer roller (12), said conveying-carding roller (7) and said first doffer roller (12) being arranged along an upper part of said first carding cylinder or main cylinder (9) a plurality of fixed carding and cleaning units (10) which cooperate with clothing of the first carding cylinder or main cylinder (9) and are arranged in a lower periphery thereof around an arc of approximately 270° of said main cylinder (9), a second carding cylinder (14), said first doffer roller (12) cooperating with the first carding cylinder (9) and also directly with said second carding cylinder (14) for transforming material therebetween, a second doffer roller (18) and a web removing assembly (20), said first and second doffer rollers (12, 18) being arranged in a lower part of said second carding cylinder (14) and fixed carding units (16) being arranged in an upper periphery thereof.

2. Card according to claim 1, further comprising, underneath said first carding cylinder (9) and its associated fixed carding units (10), a collecting hopper (24) with suction means (28) operating from beneath.

3. Card according to claim 1, characterized in that underneath said first carding cylinder (9) and its associated fixed carding units (10) is a collecting hopper (24) with suction means (28) operating from beneath.

4. Card according to claim 1, further comprising, underneath said second carding cylinder (14) and said second doffer roller (18) a second collecting hopper (26) with suction means (30) operating from beneath.

5. Card according to claim 1, wherein said first doffer roller (12) and said second doffer roller (18) are arranged around the lower periphery of the second cylinder (14).

* * * * *